US008047645B2

(12) United States Patent
Kumagai

(10) Patent No.: US 8,047,645 B2
(45) Date of Patent: Nov. 1, 2011

(54) RECORDING APPARATUS AND LIQUID EJECTING APPARATUS

(75) Inventor: Toshio Kumagai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 902 days.

(21) Appl. No.: 12/048,127

(22) Filed: Mar. 13, 2008

(65) Prior Publication Data

US 2008/0225101 A1 Sep. 18, 2008

(30) Foreign Application Priority Data

Mar. 13, 2007 (JP) ..... 2007-064066
Mar. 27, 2007 (JP) ..... 2007-082589
Jan. 24, 2008 (JP) ..... 2008-014125

(51) Int. Cl.
*B41J 2/01* (2006.01)

(52) U.S. Cl. ..... 347/102; 347/17

(58) Field of Classification Search ..... 347/17, 347/102

See application file for complete search history.

(56) References Cited

U.S. PATENT DOCUMENTS

| | | | | |
|---|---|---|---|---|
| 6,554,414 | B2 * | 4/2003 | Ylitalo et al. | 347/102 |
| 6,595,615 | B2 * | 7/2003 | Ylitalo | 347/19 |
| 7,735,992 | B2 * | 6/2010 | Kumagai | 347/102 |
| 7,753,516 | B2 * | 7/2010 | Yoneyama | 347/102 |

FOREIGN PATENT DOCUMENTS

| | | |
|---|---|---|
| JP | 05-185608 | 7/1993 |
| JP | 2002-355952 | 12/2002 |
| JP | 2003-145725 | 5/2003 |
| JP | 2004-042548 | 2/2004 |
| JP | 2004-155046 | 6/2004 |
| JP | 2005-125513 | 5/2005 |
| JP | 2005-254562 | 9/2005 |
| JP | 2005-271481 | 10/2005 |
| JP | 2005-324443 | 11/2005 |
| JP | 2007-118421 | 5/2007 |

* cited by examiner

*Primary Examiner* — Daniel Petkovsek

(74) *Attorney, Agent, or Firm* — Workman Nydegger

(57) ABSTRACT

A recording apparatus includes a support drum that rotates while supporting a recording medium on a support surface thereof. A guide axis extends in parallel with a rotation axis of the support drum along the support surface. A carriage that is guided by the guide axis moves back and forth along the support surface. A recording head for ejecting ultraviolet curing type ink toward a recording medium is supported on the support surface. The recording head has head units and is mounted on the carriage. Each head unit ejects a different type of ultraviolet curing type ink to a different position along an extending direction of the guide axis. An ultraviolet emission unit of the recording apparatus includes ultraviolet light sources that generate ultraviolet light having at least an intensity, wavelength, or emission time that is different from those of the other ultraviolet light sources.

12 Claims, 15 Drawing Sheets

400

RECORDING APPARATUS AND LIQUID EJECTING APPARATUS

BACKGROUND

1. Technical Field

The present invention relates to a recording apparatus and a liquid ejecting apparatus. In particular, the present invention relates to a recording apparatus and a liquid ejecting apparatus using ultraviolet curing type ink.

2. Related Art

There is a recording apparatus or a liquid ejecting apparatus for forming an image or a pattern on a recording medium by using ultraviolet curing type ink. The ultraviolet curing type ink has the property in which it takes a long time to be cured till ultraviolet is emitted and the property in which curing is immediately completed when ultraviolet is emitted, which are preferable for print ink. In addition, the ultraviolet curing type ink has an advantage in that it imposes a small environmental burden as no solvent is vaporized in the process of curing.

Further, the ultraviolet curing type ink has excellent properties. For example, the ultraviolet curing type ink shows high adherence property to a various recording mediums due to the composition of vehicle, is scientifically stable after curing, has high adhesiveness, drug tolerability, weather resistance, abrasion resistance, and the like, and can be withstood to outdoor condition. Consequently, an image can be formed not only on a thin sheet-like recording medium such as a paper, a resin film, a metallic foil, and the like but also on a label surface of an optical recording medium, a textile product, and the like having a three dimensional surface shape to some extent.

As for the method for adhering ultraviolet curing type ink on a recording medium, application, printing, and the like are exemplified. However, it is expected that ultraviolet curing type ink is utilized for an ink jet type recording apparatus in which any image or patter can be formed with high accuracy without a lithographic plate. In the ink jet type recording apparatus, an image can be recorded on any area also to a long recording medium or a recording medium having a large area by using a nozzle whose size is limited by the combination of reciprocating movement of a recording head for ejecting ink and movement of a recording medium in the direction perpendicular to the direction of the reciprocating movement of the recording head.

In JP-A-2004-155046, an ink jet recording apparatus is described. In the ink jet recording apparatus, an ultraviolet curing agent is included in ink and ultraviolet is emitted on a recording surface right after recording, thereby improving quick-drying of recording surface. To be more specific, it is described that ultraviolet curing type ink is used as ink and the ink adhered on a recording medium is immediately cured to fix thereon by ultraviolet lumps disposed at the both ends of a recording head in the main scanning direction in an ink jet printer.

Further, in JP-A-2005-324443 and JP-A-2005-125513, there is described an image forming apparatus having a recording head for ejecting ink that is cured by ultraviolet emission and an ultraviolet emission unit coupled to the recording head and in which an image support body, the recording head, and the ultraviolet emission unit are relatively moved. In the image forming apparatus described in the patent documents, an input digital image is formed by scanning of a plurality of recording head on the record support body and ink is independently cured by ultraviolet emission for every scan. Further, in JP-A-2004-042548, it is described that an ultraviolet emission device is independently provided for every color in the recording apparatus that ejects ultraviolet curing type ink having a different color to each other from nozzles to perform color printing.

The ultraviolet curing type ink has different transmittance property to ultraviolet depending on the type, for example the color, of the ink, so that curing speed is also different. Further, the transmittance property to ultraviolet is also changed in accordance with the thickness of ultraviolet curing type ink adhered on a recording medium. Consequently, when recording operation is performed by using different type of inks for color printing or the like, there is a case in that curing of a specific type of ink takes a long time. However, when the ink which is not yet cured is mixed on the surface of a recording medium, bleeding occurs in an image after curing, thereby deteriorating image quality.

Further, when ultraviolet is emitted for the ink which is most difficult to cure, there is a case that not only emission energy is uselessly consumed, but also curing speed of another type of ink becomes too fast. The ultraviolet curing type ink itself is cured and fixed, so that the volume of the ink does not decrease after adhesion. Consequently, when the curing speed is too fast, the ink is cured to rise from the surface of a recording medium and the surface texture becomes coarse.

It is proposed that the mutual difference of the property of the type of the ultraviolet curing type ink is compensated by, for example, adjusting the composition of the ultraviolet curing component contained in the ink. However, the difference is not compensated. Further, it is proposed that an ultraviolet emission device is independently provided in accordance with the ink ejected from each of recording heads. However, there occurs problems in that the weight and the size of the carriage becomes too large, the scale of the device becomes large, and the improvement of operational speed is restricted in the structure in which a recording head and a plurality of ultraviolet emission devices are mounted on a plurality of carriages.

SUMMARY

According to a first aspect of the invention to solve the problem described above, there is provided a recording apparatus including a support drum that rotates while supporting a recording medium on a support surface of the support drum, a guide axis extending in parallel with a rotation axis of the support drum along the support surface, a carriage that is guided by the guide axis and moves back and forth along the support surface, a recording head for ejecting ultraviolet curing type ink toward a recording medium supported on the support surface, the recording head being mounted on the carriage and the recording head having a plurality of head units each of which ejects a different type of ultraviolet curing type ink to each other to a different position to each other along an extending direction of the guide axis, and an ultraviolet emission unit disposed at a down stream side of the carriage in a rotation direction of the support drum, the ultraviolet emission unit emitting ultraviolet to the ultraviolet curing type ink ejected from the recording head and adhered on the recording medium, the recording apparatus forming an image by ejecting ultraviolet curing type ink on an entire surface of the recording medium supported by the support drum by moving the carriage along the guide axis for each time the support drum rotates at least one revolution. The ultraviolet emission unit has a plurality of ultraviolet light sources disposed in the extending direction of the guide axis and each of the ultraviolet light sources independently generates ultraviolet, and each of the ultraviolet light sources generates ultraviolet by an emission condition in which at least one of intensity, wavelength, and emission time of ultraviolet is different to each other. Herewith, insufficient curing or deterioration of surface property can be prevented as ultraviolet can be emitted by an appropriate emission condition in accordance with the type of the ultraviolet curing type ink. Further, it is prevented that ultraviolet is uselessly emitted. Further, operational speed of the recording apparatus can be improved.

It is preferable that at least one of the plurality of head units have a plurality of nozzles that eject a different type of ink from the other head unit, and the emission condition different to each other depends on the type of ink different to each other in the above described recording apparatus. Herewith, ultraviolet can be emitted by an individual emission condition for every recording head unit. Accordingly, the emission condition of ultraviolet can be individually adjusted to the property of the ultraviolet curing type ink ejected from each of the recording head units.

Further, it is preferable that the ultraviolet emission unit emits ultraviolet with respect to ultraviolet curing type ink adhered on the topmost layer of the recording medium after the support drum is rotated not less than one revolution after the ultraviolet curing type ink is adhered on the recording medium in the above described recording apparatus. Herewith, the surface of the ink can be smoothed by delaying the start of curing of the ultraviolet curing type ink formed on the topmost layer of an image.

Further, it is preferable that the ultraviolet emission unit includes a movable ultraviolet light source that moves along the extending direction of the guide axis with respect the other ultraviolet light source in the above described recording apparatus. Herewith, the emission timing of ultraviolet by the movable ultraviolet light source can be considerably changed with respect to the other ultraviolet light source. Accordingly, for example, the surface of the ink can be smoothed by delaying the start of curing of the ultraviolet curing type ink formed on the topmost layer of an image.

Further, it is preferable that the ultraviolet emission unit has an emission unit carriage that mounts the ultraviolet light sources, the emission unit carriage being guided by an emission unit guide axis disposed in parallel with the guide axis and moving back and forth in synchronization with the carriage in the above described recording apparatus. Herewith, the load to a driving mechanism for moving the carriages can be reduced by separating the carriage that mounts the recording head and moves back and forth and the emission unit carriage that mounts ultraviolet emission unit. Further, herewith, the scale, weight, and the like of the whole recording apparatus can also be reduced.

Further, it is preferable that each of the ultraviolet light sources includes a plurality of ultraviolet light emitting elements arranged in the rotation direction of the support drum and at least a part of the plurality of ultraviolet light emitting elements is independently turned on or turned off in the above described recording apparatus. Herewith, emission amount and emission time of ultraviolet can be adjusted by electrical control with respect to an individual ultraviolet light emitting element.

Further, it is preferable that each of the ultraviolet light sources includes a plurality of ultraviolet light emitting elements arranged in the direction parallel to the extending direction of the guide axis and at least a part of the plurality of ultraviolet light emitting element is independently turned on or turned off in the above described recording apparatus. Herewith, ultraviolet emission amount per unit time can also be adjusted by electrical control with respect to an individual ultraviolet light emitting element.

Further, it is preferable that the ultraviolet light source includes a plurality of ultraviolet light emitting elements having a different emission wavelength to each other in the above described recording apparatus. Herewith, the ultraviolet emission condition can be optimized by emitting ultraviolet having various wavelengths in accordance with the type of the ink.

Further, it is preferable that each of the ultraviolet light sources has a support frame and a plurality of ultraviolet light emitting element units that independently generates ultraviolet when attached to the support frame, the ultraviolet light emitting element units being capable of independently attaching to and detaching from the support frame, and emission condition including at least one of the intensity, wavelength, and emission time of ultraviolet emitted to the ink adhered on the recording medium is changed by appropriately attaching or detaching the ultraviolet light emitting element units in the above described recording apparatus. Herewith, emission wavelength, emission time, emission intensity can be changed in each of the ultraviolet light sources. Further, the emission condition of ultraviolet can be provided within a wide rage, as is not predicted in the beginning, by attaching the ultraviolet light emitting element unit.

Further, it is preferable that each of the ultraviolet light sources has a support frame and a plurality of ultraviolet light emitting element units that independently generates ultraviolet when attached to the support frame, the ultraviolet light emitting element units being capable of independently attaching to and detaching from the support frame, and the plurality of ultraviolet light emitting element units have the same shape and same size to each other and attachment positions of the plurality of ultraviolet light emitting element units are changed in the above described recording apparatus. Herewith, any emission condition can be set by appropriately disposing the ultraviolet light emitting element units having various emission wavelengths and emission intensities. Further, as any ultraviolet light emitting element unit can be attached to any position, the flexibility of ultraviolet emission condition is further enhanced.

Further, it is preferable that each of the ultraviolet light sources includes a support frame, a plurality of ultraviolet light emitting element units that independently generates ultraviolet when attached to the support frame, the ultraviolet light emitting element units being capable of independently attaching to and detaching from the support frame, and a blank unit that does not generate ultraviolet, the blank unit being capable of independently attaching to and detaching from the support frame, and the plurality of ultraviolet light emitting element units and the blank unit have the same shape and same size to each other and attachment positions of the plurality of ultraviolet light emitting element units and the blank unit to the support frame are changed in the above described recording apparatus. Herewith, the emission condition of ultraviolet can be changed without disturbing layer flow generated on the surface of the support drum, and it is prevented that the quality of an image formed by ejection of ultraviolet curing type ink is deteriorated.

Further, it is preferable that at least one of emission intensity and emission wavelength of a part of the plurality of ultraviolet light emitting element units is different from that of the other ultraviolet light emitting element unit in the above described recording apparatus. Herewith, the range of emission condition of ultraviolet to be set can be further increased.

Further, according to a second aspect of the invention, there is provided a liquid ejecting apparatus including a support drum that rotates while supporting a recording medium on a support surface of the support drum, a guide axis extending in parallel with a rotation axis of the support drum along the support surface, a carriage that is guided by the guide axis and moves back and forth along the support surface, a liquid ejecting head for ejecting ultraviolet curing type liquid toward a recording medium supported on the support surface, the liquid ejecting head being mounted on the carriage and the liquid ejecting head having a plurality of head units each of which ejects a liquid containing a different type of ultraviolet curing component to each other to a different position to each other along an extending direction of the guide axis, and an ultraviolet emission unit disposed at a down stream side of the carriage in a rotation direction of the support drum, the ultraviolet emission unit emitting ultraviolet to the ultraviolet curing type liquid ejected from the liquid ejecting head and adhered on the recording medium, the liquid ejecting apparatus forming an image by ejecting ultraviolet curing type liquid on an entire surface of the recording medium supported by the support drum by moving the carriage along the guide axis for each time the support drum rotates at least one revolution. The ultraviolet emission unit has a plurality of ultraviolet light sources disposed in the extending direction of the guide axis and each of the ultraviolet light sources independently generates ultraviolet, and each of the ultraviolet light sources generates ultraviolet by an emission condition in which at least one of intensity, wavelength, and emission time of ultraviolet is different to each other. Herewith, the above described effects can be provided also by the liquid ejecting apparatus.

It should be noted here that the outline of the invention described above does not list all the characteristics needed for the invention. Further, the invention may also be a sub combination of these described features.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described through an embodiment. However the embodiment does not restrict the invention according to the claims. Further, all of the combinations of the characteristics described in the embodiment are not always necessary for the solution of the invention.

Figure 1:
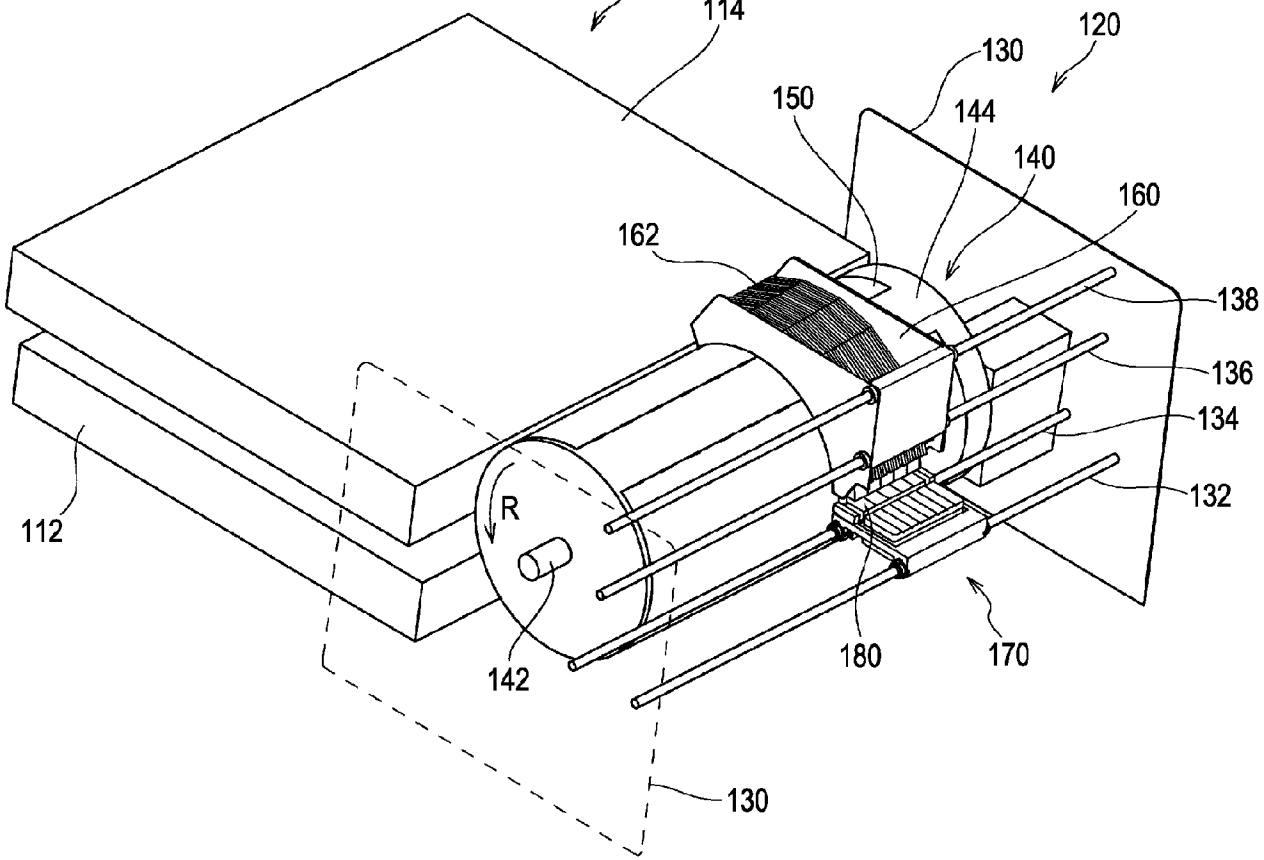
FIG. 1 is a diagram schematically showing the entire structure of an ink jet type recording apparatus according to an embodiment.

FIG. 1 is a perspective view schematically showing the structure of an ink jet type recording apparatus 100 according to an embodiment. As shown in FIG. 1, the ink jet type recording apparatus 100 is formed by a recording unit 120 formed between a pair of facing and upstanding recording unit frames 130 and a paper feed/eject unit 110 including a paper feed unit 112 and a paper eject unit 114.

The recording unit 120 is supported between the pair of recording unit frames 130 parallel to each other and has a support drum 140 and guide axes 132, 134, 136, 138. A horizontal rotation axis 142 of the support drum 140 is pivotally supported by the recording unit frames 130, and the support drum 140 rotates in the direction shown by the arrow R in FIG. 1 in the state where a recording paper 150 is hold on a support surface 144. Note that the member for rotating and driving the support drum 140 is omitted in FIG. 1.

On the other hand, a pair of the guide axes 132, 134 among the two pairs of guide axes 132, 134, 136, 138 parallel to each other pass through a recording unit carriage 170 and support the recording unit carriage 170 under the state where the recording unit carriage 170 can be moved back and forth. A recording head 180 is mounted on the recording unit carriage 170.

The other pair of guide axes 136, 138 support an emission unit carriage 160 also under the state where the emission unit carriage 160 can be moved back and forth. An ultraviolet emission unit 162 described below is mounted on the emission unit carriage 160. Note that a driving mechanism that moves the emission unit carriage 160 and the recording unit carriage 170 is omitted in FIG. 1.

The paper feed unit 112 supplies a sheet recording paper 150 one by one to the recording unit 120 having the structure described above. The recording paper 150 supplied to the recording unit 120 is wound around the support surface 144 of the support drum 140 to rotate with the support drum 140.

The recording head 180 mounted on the recording unit carriage 170 ejects and adheres ultraviolet curing type ink to the recording paper 150 that rotates in the state where supported by the support drum 140. Further, ultraviolet is emitted to the ultraviolet curing type ink adhered on the recording paper 150 from the ultraviolet emission unit 162. Herewith, an image formed by ultraviolet curing type ink is fixed on the surface of the recording paper 150.

Further, when the support drum 140 is rotated not less than one revolution and an image is recorded on a part of the area of the recording paper 150 in the longitudinal direction of the support drum 140, the recording unit carriage 170 moves along the guide axes 132, 134 and similar recording operation is performed to the area adjacent to the above described area. By repeating the operation of moving the recording unit carriage 170 for each time the support drum 140 is rotated not less than one revolution while performing recording operation by the recording head 180, an image can be formed on the entire surface of the recording paper 150.

In other words, in the ink jet type recording apparatus 100, the rotation direction of the support drum 140 is the main scanning direction and the moving direction of the recording unit carriage 170 is the sub scanning direction. This is different from many recording apparatuses in which the moving direction of the carriage is the main scanning direction and the transport direction of the recording paper 150 agrees with the sub scanning direction of the carriage.

Note that the illumination unit carriage 160 on which the ultraviolet emission unit 162 is mounted moves approximately in synchronization with the movement of the recording unit carriage 170 and emits ultraviolet to the ultraviolet curing type ink right after ejected on the recording paper 150 from the recording head 180. However, preferably, the peak of the load to the power source unit of the ink jet type recording apparatus 100 can be reduced by slightly delaying the timing of starting of the movement of the emission unit carriage 160 and the recording unit carriage 170.

That is, when the emission unit carriage 160 and the recording unit carriage 170 are united, the inertial mass which becomes the target of acceleration becomes too large when movement of the carriage is started, so that the load to the driving mechanism becomes too large. Further, when the large mass is stably accelerated or deaccelerated, the recording unit frame 130 having a high intensity and a large weight is required.

Accordingly, by the structure in which the emission unit carriage 160 and the recording unit carriage 170 are separated and independently moved, the capacitance of the power supply device can be reduced and reduction, cost down, and the like of the whole recording apparatus can be provided. The recording paper 150 on which an image is recorded in this manner is taken out from the support drum 140 and taken into the paper eject unit 114 to be accumulated.

Figure 2:
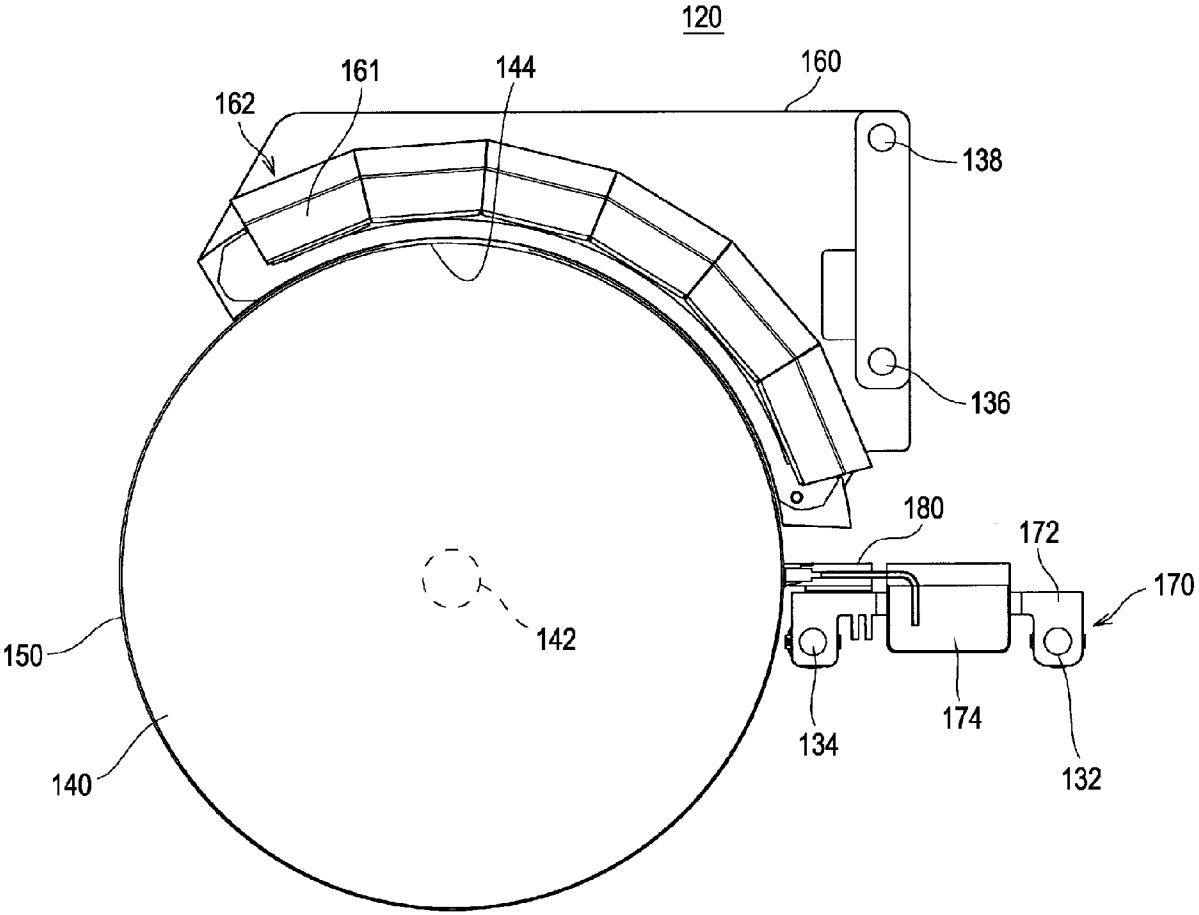
FIG. 2 is a diagram showing a cross sectional structure of a recording unit of the ink jet type recording apparatus.

FIG. 2 is a cross sectional view showing the structure of the recording unit 120 of the ink jet type recording apparatus 100 shown in FIG. 1. As shown in FIG. 2, the recording unit 170 is supported by the pair of the guide axes 132, 134, is equipped with an ink tank 174, and supports the recording head 180 in the recording unit 120.

The ink tank 174 keeps the ink supplied from an ink cartridge not shown in FIG. 2 by a predetermined amount and stably supplies the ink to the recording head 180. The recording head 180 is disposed just near the recording paper 150 held by the support surface 144 of the support drum 140 and ejects ink toward the recording paper 150.

The ultraviolet emission unit 162 includes ultraviolet light source 161 extending along the rotation direction of the support drum 140. Herewith, even when a light emitting element whose ultraviolet output is small is used, emission time can be lengthen and sufficient ultraviolet emission amount can be obtained by continuing emission of ultraviolet while the recording paper 150 rotates.

In the recording unit 120, the recording paper 150 on which the ink ejected from the recording head 180 is adhered rotates and moves in the direction shown by the arrow R in FIG. 1 in accordance whit the rotation of the support drum 140. The ultraviolet emission unit 162 supported by the emission unit carriage 160 is disposed at the downstream side of the recording head 180 in the rotation direction. Accordingly, the ultraviolet curing type ink ejected from the recording head 180 and adhered on the recording paper 150 instantaneously begins to cure by emission of ultraviolet.

Figure 3:
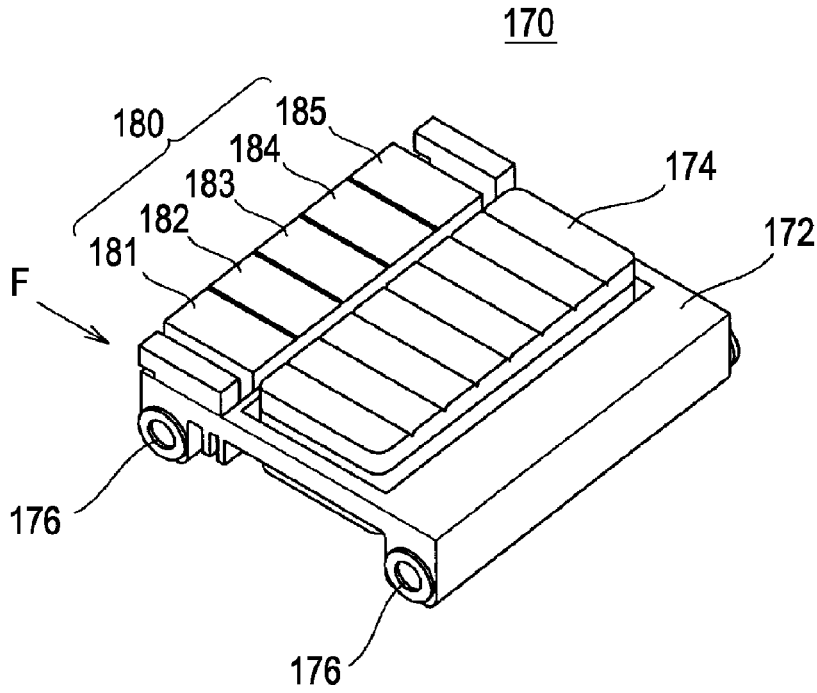
FIG. 3 is a perspective view independently showing a recording unit carriage.

FIG. 3 is a perspective view independently showing the recording unit carriage 170 on which the recording head 180 is mounted. As shown in FIG. 3, the recording unit carriage 170 has a pair of horizontal though holes 176 through which the guide axes 132, 134 are inserted, and a carriage main body 172 equipped with the ink tank 174. The recording head 180 is mounted on the upper surface of the carriage main body 172. Note that the recording head 180 is equipped with five head units 181 to 185 as described below. Each of the head units 181 to 185 ejects a different type of ink to each other.

Figure 4:
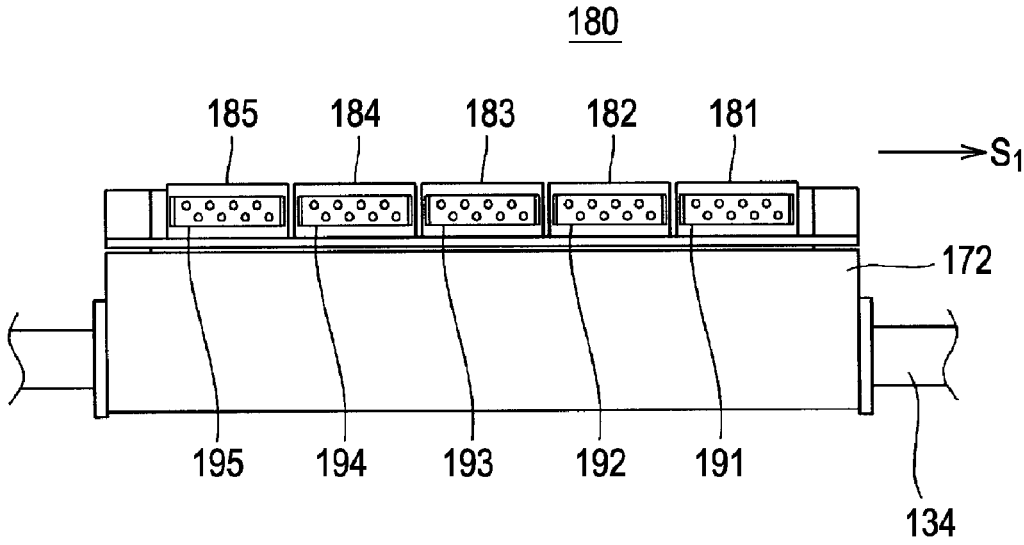
FIG. 4 is a front view showing a recording head from the front side.

FIG. 4 is a front view showing the recording head 180 from the direction shown by the arrow F of FIG. 3. As shown in FIG. 4, the recording head 180 includes the five head units 181 to 185. Each of the head units 181 to 185 is equipped with corresponding one of nozzle plates 191 to 195 on the surface opposing the recording paper 150 supported by the support drum 140. Nozzles for ejecting ultraviolet curing type ink are formed in each of the nozzle plates 191 to 195. Note that as for the driving structure for ejecting ink from the head units 181 to 185, there has been already known various method such as a system for absorbing a liquid drop of ink by electrostatic force or the like, a system for blasting ink by using a crystal oscillator, a piezoelectric element, or the like, and the like. The systems can be appropriately selected depending on the application.

Figure 5:
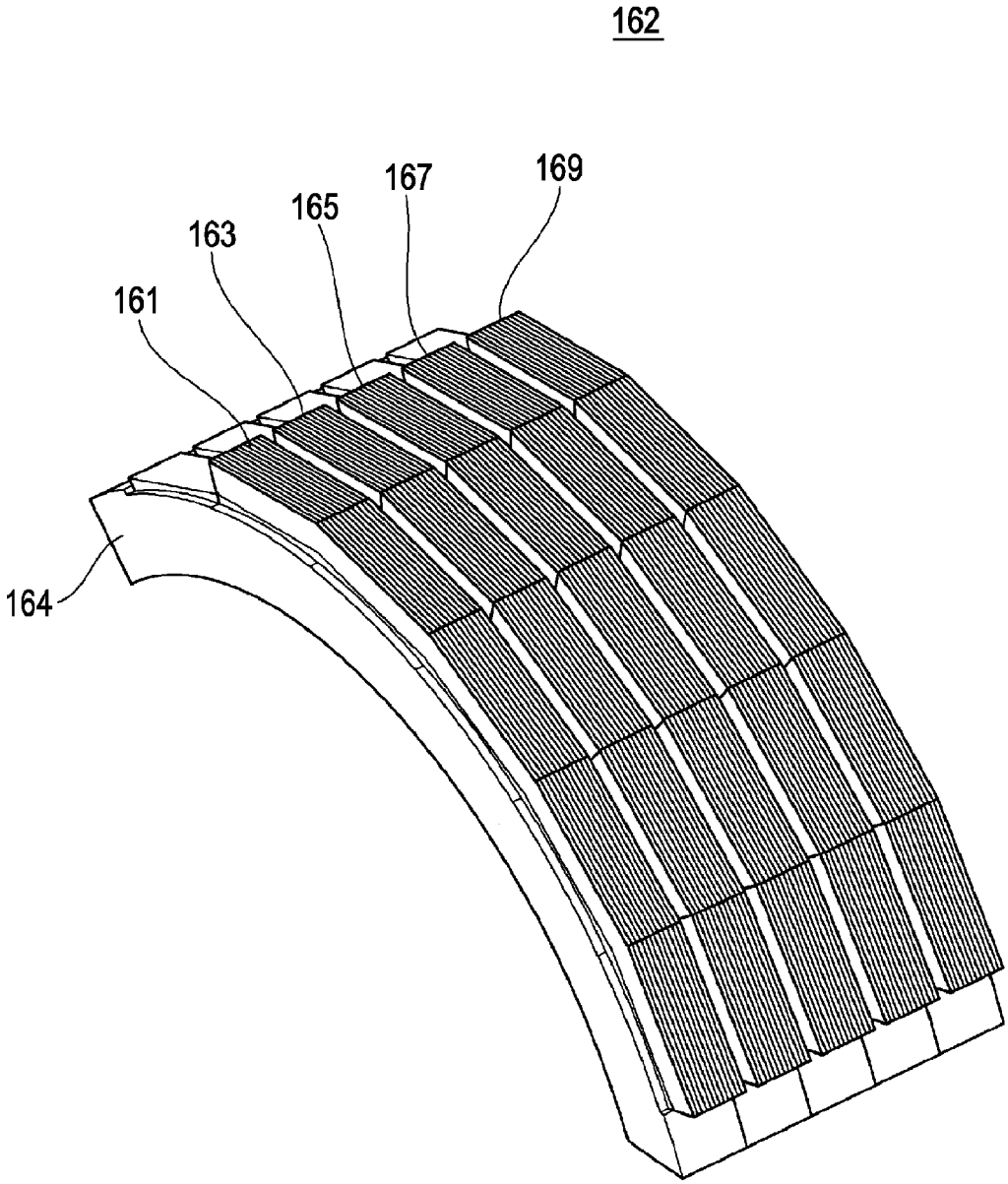
FIG. 5 is a perspective view independently showing an ultraviolet emission unit.

FIG. 5 is a perspective view independently showing the ultraviolet emission unit 162 mounted on the emission unit carriage 160. As shown in FIG. 5, the ultraviolet emission unit 162 is equipped with a plurality of ultraviolet light sources 161, 163, 165, 167, 169 attached to a common emission unit frame 164. Each of the ultraviolet light sources 161, 163, 165, 167, 169 disposed in five lines so as to correspond to the head units 181 to 185 of the recording head 180 has a circular arc shape along the shape of the support surface 144 of the support drum 140.

Figure 6:
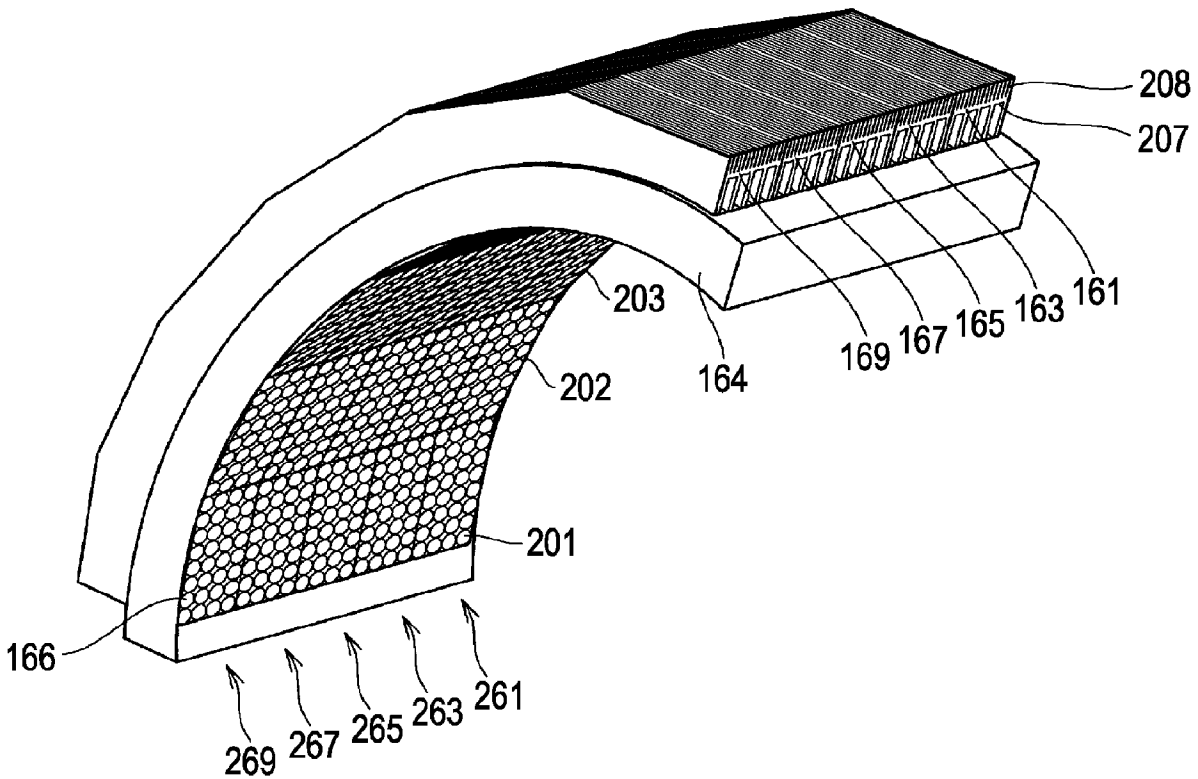
FIG. 6 is a perspective view showing an appearance of the ultraviolet emission unit from another viewpoint.

FIG. 6 is a perspective view showing the ultraviolet emission unit 162 from the side opposite to FIG. 5. As shown in FIG. 6, a number of ultraviolet light emitting elements 166 are arranged in each of the ultraviolet light sources 161, 163, 165, 167, 169 on the surface opposing the support drum 140 and forms element lines 261, 263, 265, 267, 269. Further, the ultraviolet emission elements 166 are grouped into six element groups 201 to 206 which becomes units to be controlled described below in the longitudinal direction of each of the ultraviolet light sources 161, 163, 165, 167, 169 (in FIG. 6, only the element groups 201 to 203 can be viewed).

Further, each of the ultraviolet light sources 161, 163, 165, 167, 169 has a radiation fin 208 formed at the upper surface thereof and flow holes 207 formed therein. By the structure, each of the ultraviolet light sources 161, 163, 165, 167, 169 has a high mechanical strength without increasing the weight and efficiently diffuses heat generated by the ultraviolet light emitting elements 166.

Note that it is preferable that the width of the emission range of each of the ultraviolet light sources 161, 163, 165, 167, 169 is wider than the recording width of each of the head units 181 to 185. Herewith, a sufficient emission amount of ultraviolet can be emitted to the ultraviolet curing type ink adhered on the recording paper 150 even when the timings of the movement of the emission unit carriage 160 and the recording unit carriage 170 are staggered.

Further, as for the ultraviolet light emitting element 166, a metal halide lamp, a xenon lamp, a carbon-arc lamp, a chemical lamp, a low-pressure mercury lamp, a high-pressure mercury lamp, and the like can be exemplified. To be more specific, available Fusion System H lamp, D lamp, V lamp, and the like can be available.

Further, an LED that emits light in the ultraviolet band can be available. In particular, when a number of ultraviolet light emitting elements are arranged as shown in FIG. 6, it is advantageous to use an LED mainly from the viewpoint of the size of the element.

Further, the ultraviolet curing type ink which can be cured by emitting ultraviolet generated by the ultraviolet light emitting elements 166 is prepared by adding an auxiliary substance such as antifoam, a polymerization inhibitor, or the like to the mixture of a vehicle, a photopolymerization initiator and a pigment. The vehicle is prepared by adjusting an oligomer, a monomer, or the like having photopolymerization curing property in viscosity by a reactive diluent. Accordingly, it is prevented that the solvent is vaporized in the purpose to cure the ink.

A monofunctional or multifunctional polymerizable compound can be available for the vehicle. To be more specific, oligomer (prepolymer) such as polyester acrylate, epoxy acrylate, urethane acrylate, and the like can be exemplified. These materials can also be available for the reactive diluent for adjusting the viscosity as ink.

Benzophenone series, benzoin series, acetophenone series, and thioxanthone series are widely available for the photopolymerization initiator. To be more specific, water-soluble organic matter of quaternary ammonium salt type or the like such as 4-benzoyl-N,N,N-trimethyl benzene methaneannmonium chloride, 2-hydroxy 3-(4-benzoyl-phenoxy)-N,N,N-trimethyl 1-propane annmonium chloride, 4-benzoyl-N,N-dimethyl N-[2-(1-oxo-2-propenyloxy)ethyl]benzene methammonium bromide, or the like can be available. Ultraviolet absorbing property, reaction initiating efficiency, yellowing, and the like are different in such a type of photopolymerization initiator depending on the composition thereof, so that the photopolymerization initiator is selectively used depending on the color or the like as the ink.

As the polymerization inhibitor, any compound can be available as long as having radical capture ability and preventing radical polymerization. However, when considering the ejection property or the like in the ink jet type recording apparatus, at least not less than one type of compound selected from hydroquinone, catechol, hindered amine, phenol, phenothiazine, and quinone of fused aromatic ring is preferable.

As for the hydroquinone, exemplified are hydroquinone, hydroquinone monomethyl ether, 1-o-2,3,5-trimethyl hydroquinone, 2-tert-butyl hydroquinone, and the like. As for the catechol, exemplified are catechol, 4-methyl catechol, 4-tert-butyl catechol, and the like. As for the hindered amine, a compound having a tetramethyl piperidinyl group and the like is exemplified.

Further, as for the phenol, exemplified are phenol, butyl hydroxytoluene, butyl hydroxyanisole, pyrogallol, gallic acid, gallic acid alkyl ester, and the like. As for the phenothiazine, phenothiazine, and the like is exemplified. As for the quinone of fused aromatic ring, naphthoquinone, and the like is exemplified.

Further, the polymerization inhibitor may be a carbon black or an inorganic-organic fine particle in which polymerization inhibiting functional group is introduced on the surface. As for the polymerization inhibiting functional group, exemplified are, for example, hydroxyphenyl group, dihydroxyphenyl group, tetramethyl piperidinyl group, fused aromatic ring, and the like.

Figure 7:
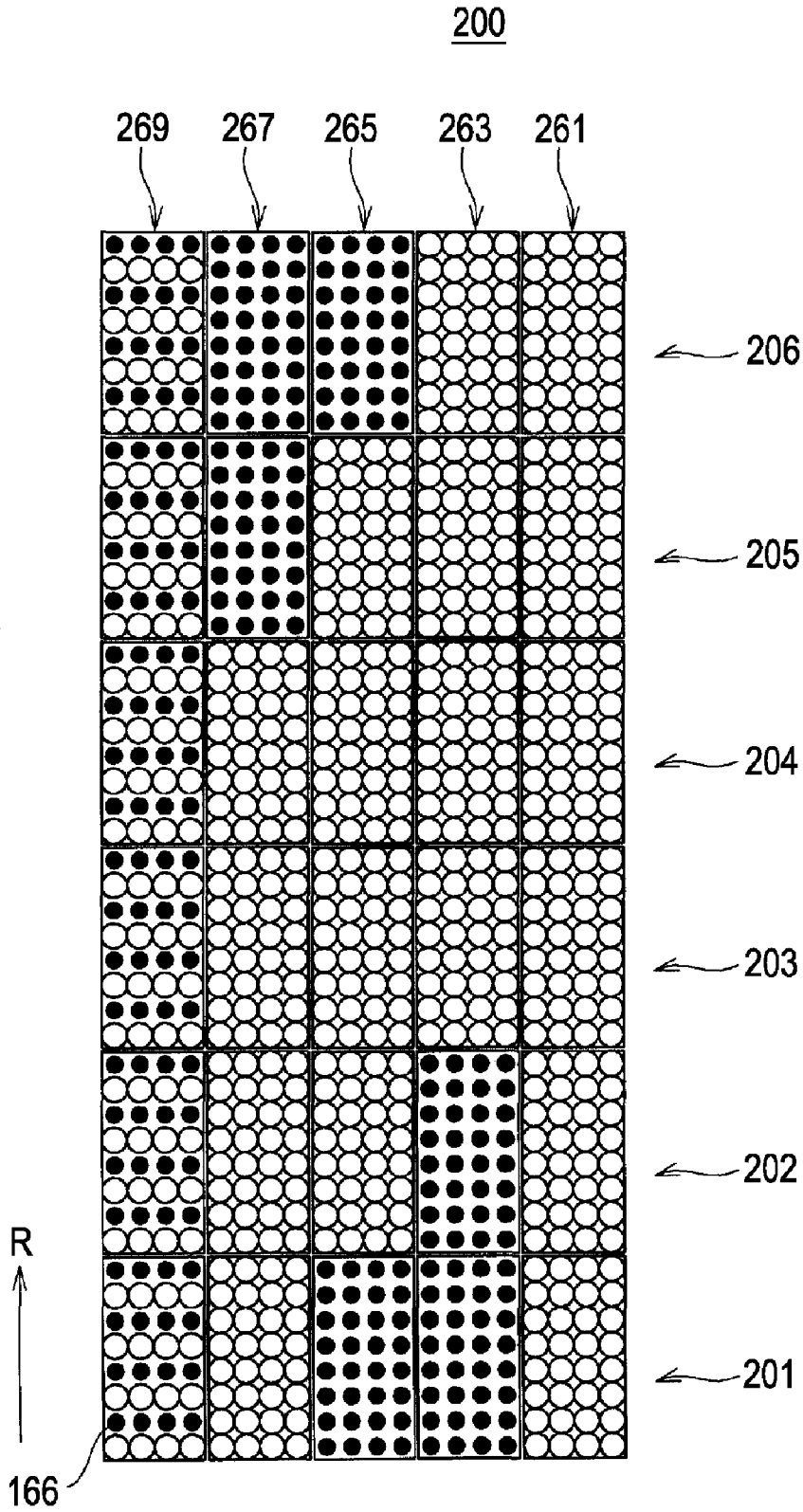
FIG. 7 is a diagram showing a turned on state of ultraviolet light emitting elements.

FIG. 7 is a diagram schematically showing a turned-on state 200 of the ultraviolet light emitting elements 166 of the ultraviolet emission unit 162. Note that in FIG. 7, the turned on ultraviolet light emitting element 166 is displayed by white circle and the turned off ultraviolet light emitting element 166 is displayed by black circle.

First, as shown in FIG. 7, the ultraviolet emission unit 162 has a number of ultraviolet light emitting elements 166. Accordingly, even when the emission intensity of the each of the ultraviolet light emitting elements 166 is low, a sufficient ultraviolet emission amount can be obtained as the whole. Further, as also shown in FIG. 7, each of the ultraviolet light emitting elements 166 can be individually turned on and turned off in the ultraviolet emission unit 162.

Herein, in the turned on state 200 shown in FIG. 7, all of the element groups 201 to 206 of the element line 261 are turned on. Herewith, ultraviolet is emitted to the ultraviolet curing type ink ejected from the head unit 181 corresponding to the element line 261 by high emission intensity and a long emission time. Herewith, the ultraviolet curing type ink ejected from the head unit 181 is sufficiently cured and the surface texture thereof becomes coarse. Such an ultraviolet emission property becomes advantageous when forming an undercoat layer formed right above the recording paper 150 in the whole area in which an image is formed on the recording paper 150.

Further, in the element lines 263, 265, 267 of the ultraviolet emission unit 162, a part of the element groups 201 to 206 is turned on. Herewith, emission to the ink ejected from the head units 182, 183, 184 is respectively started at a different timing. Further, the emission intensity per unit time becomes the same as that of the element line 261, but the time emitted by each of the lines 263, 265, 267 is short. Herewith, the ultraviolet curing type ink ejected from the head units 182, 183, 184 forms an ink layer which is not perfectively cured although viscosity is increased. Accordingly, each of the ultraviolet curing type ink ejected from the head units 182, 183, 184 are not mixed to each other and peeling of the layers respectively formed by a different type of ink is difficult to occur. Note that the curing of the ultraviolet curing type ink is developed, so that the ultraviolet curing type ink ejected from the head units 182, 183, 184 also is eventually completely cured.

Further, in the element line 269, half of the ultraviolet light emitting elements 166 are turned off in the all of the element groups 201 to 206. Accordingly, an emission amount of ultraviolet with respect to the ultraviolet curing type ink ejected from the head unit 185 is also lowered. Herewith, the ink ejected from the head unit 185 is slowly cured after sufficiently spread on the recording paper 150 and forms a flat surface. Such an ultraviolet emission property becomes advantageous in forming an overcoat layer formed on the uppermost surface of an image.

Figure 8:
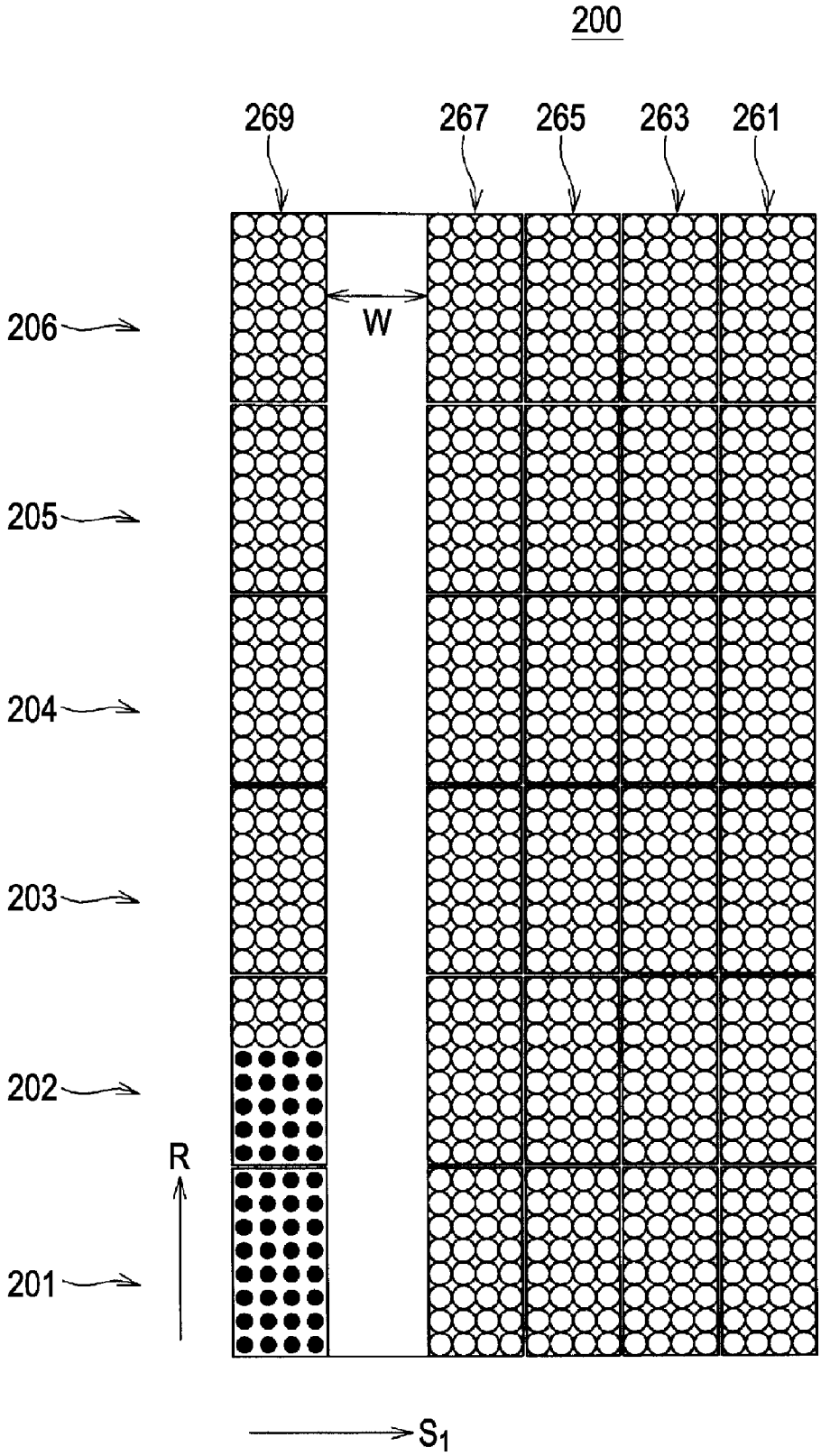
FIG. 8 is a diagram showing the ultraviolet emission unit of another embodiment by a turned on state.

FIG. 8 is a diagram showing another embodiment of the ultraviolet emission unit 162 itself by a turned on state 200 of the ultraviolet elements 166. Note that also in FIG. 8, the turned on ultraviolet emission element 166 is displayed by a white circle and the turned off ultraviolet emission element 166 is displayed by a black circle.

As shown in FIG. 8, in the ultraviolet emission unit 162, ultraviolet light source 169 forming the element line 269 disposed at the most side portion is disposed so as to be apart from the other ultraviolet light sources 161, 163, 165, 167 in the rear direction with respect to the sub scanning direction shown by the arrow $S_1$ in FIG. 8. In this case, the width W of the gap formed between the element line 267 and the element line 269 is equal to the width of the head unit 185 of the recording head 180 in the sub scanning direction. Accordingly, in the recording operation of the ink jet type recording apparatus 100, the ultraviolet curing type ink ejected from the nozzles of the nozzle plate 195 of the head unit 185 is not emitted by ultraviolet during the main scanning period.

Further, when the recording head 180 is moved in the direction shown by the arrow $S_1$ of FIG. 8 during the sub scanning, the element line 269 is moved to the tail end of the emission unit carriage 160. Herewith, the ultraviolet emitted from the element line 269 is emitted to the ultraviolet curing type ink ejected from the nozzles of the nozzle plate 195 of the head unit 185 after the head drum 140 is rotated not more than one revolution and the emission unit carriage 160 is moved.

In this manner, there is a sufficient time from when the ultraviolet curing type ink ejected from the nozzles of the nozzle plate 195 is adhered on the recording paper 150 to when the ink begins to cure. Accordingly, the surface of the cured ink layer finally obtained becomes a flat surface. Such a property becomes advantageous for forming an overcoat layer formed by transparent ink on the topmost surface of an image. Note that as shown in FIG. 8, the timing for starting emission of ultraviolet can be further delayed by turning off a part of the ultraviolet light emitting elements 166 included in the element groups 201, 202 of the element line 269.

Note that although a drawing is omitted, an ultraviolet light emitting element 166 having a different emission wavelength, emission intensity, or the like to be attached may be mixed in each of the ultraviolet light sources 161, 163, 165, 167, 169. Herewith, emission wavelength can be also changed in addition to the timing of starting of emission, emission strength, and emission time by electrically controlling turning on and turning off of the ultraviolet light emitting elements 166.

Figure 9:
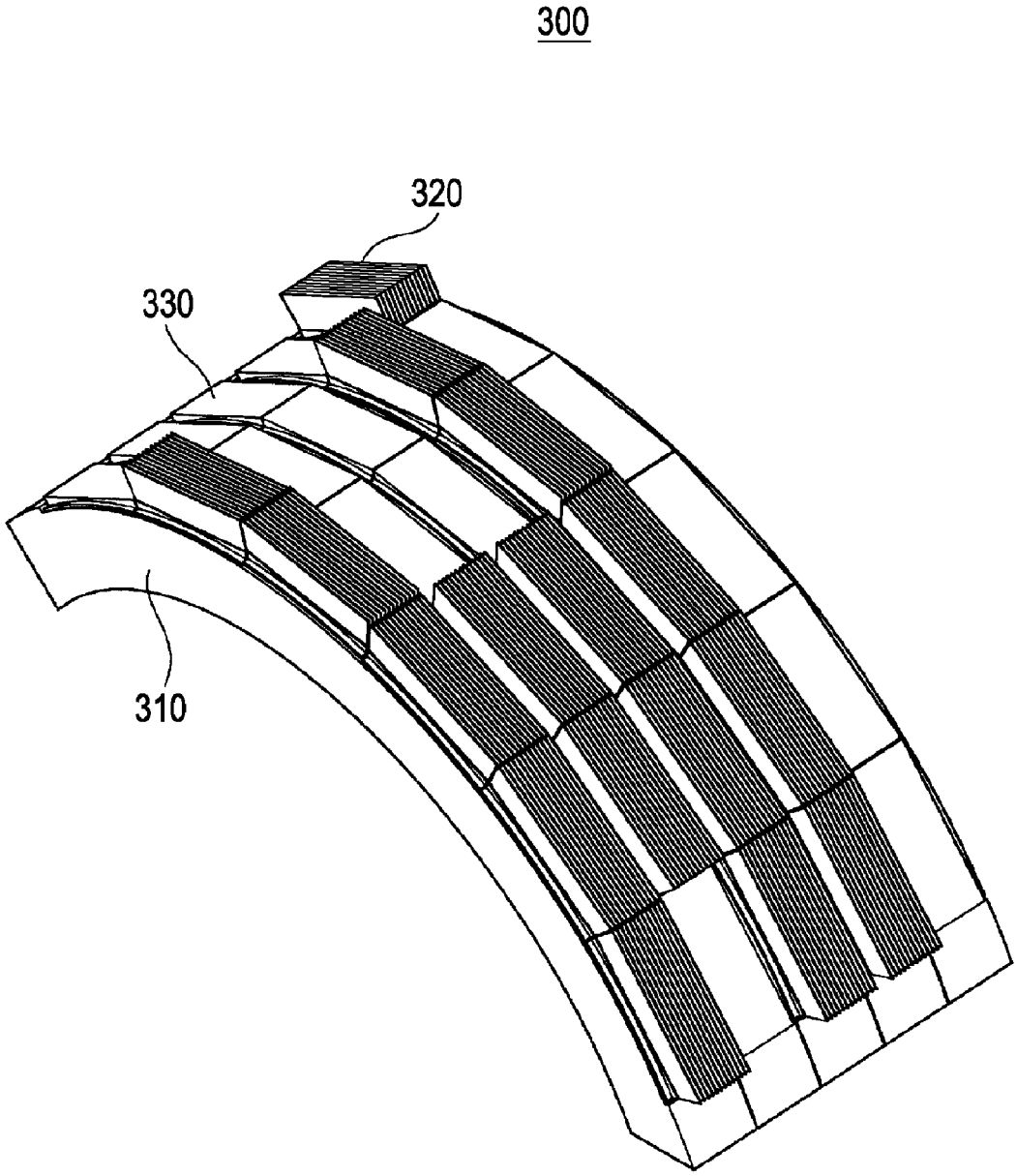
FIG. 9 is a perspective view showing an ultraviolet emission unit according to another embodiment.

FIG. 9 is a perspective view showing an appearance of an ultraviolet emission unit 300 having another structure. As shown in FIG. 9, the ultraviolet emission unit 300 is equipped with a support frame 310 and ultraviolet light emitting element units 320 and blank units 330 attached to the support frame 310. Note that the ultraviolet emission unit 300 has the same shape as the ultraviolet emission unit 162 shown in FIGS. 5 and 6 as the whole and can be attached to the ink jet type recording apparatus 100 instead of the ultraviolet emission unit 162.

Figure 10:
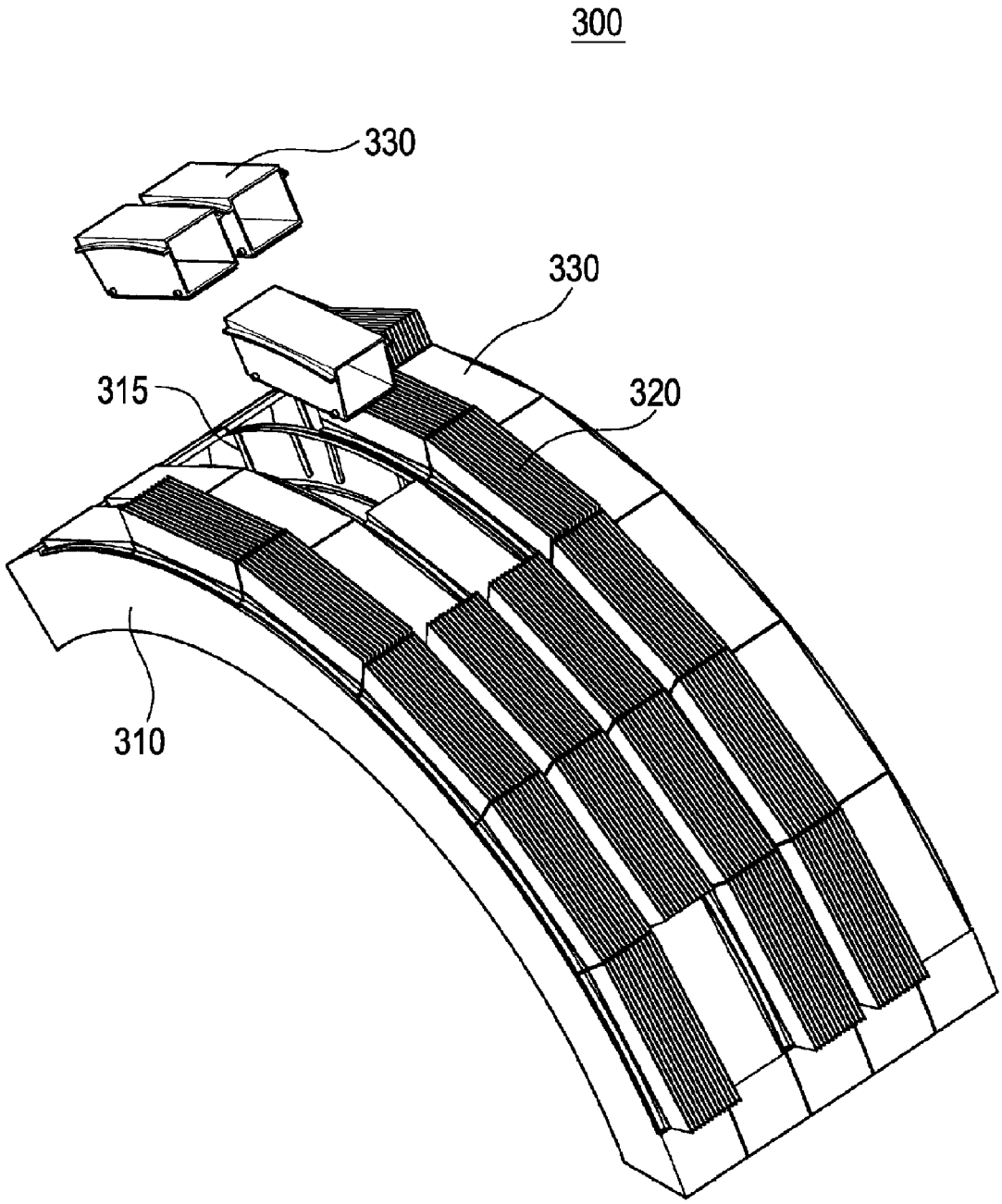
FIG. 10 is a perspective view illustrating the function of the ultraviolet emission unit.

FIG. 10 is a diagram showing another state of the ultraviolet emission unit 300 shown in FIG. 9. The ultraviolet light emitting element unit 320 and the blank unit 330 can be independently attached to and detached from the support frame 310 in the ultraviolet emission unit 300. Further, as described below, the ultraviolet light emitting element unit 320 has ultraviolet light emitting elements 302 (see FIG. 13), but the blank unit 330 has no light emitting element (see FIG. 12). Accordingly, by attaching the ultraviolet light emitting element unit 320 to an appropriate position, a timing for starting emission, an amount of ultraviolet emission, and a time of ultraviolet emission as the ultraviolet emission unit 300 can be set.

Figure 11:
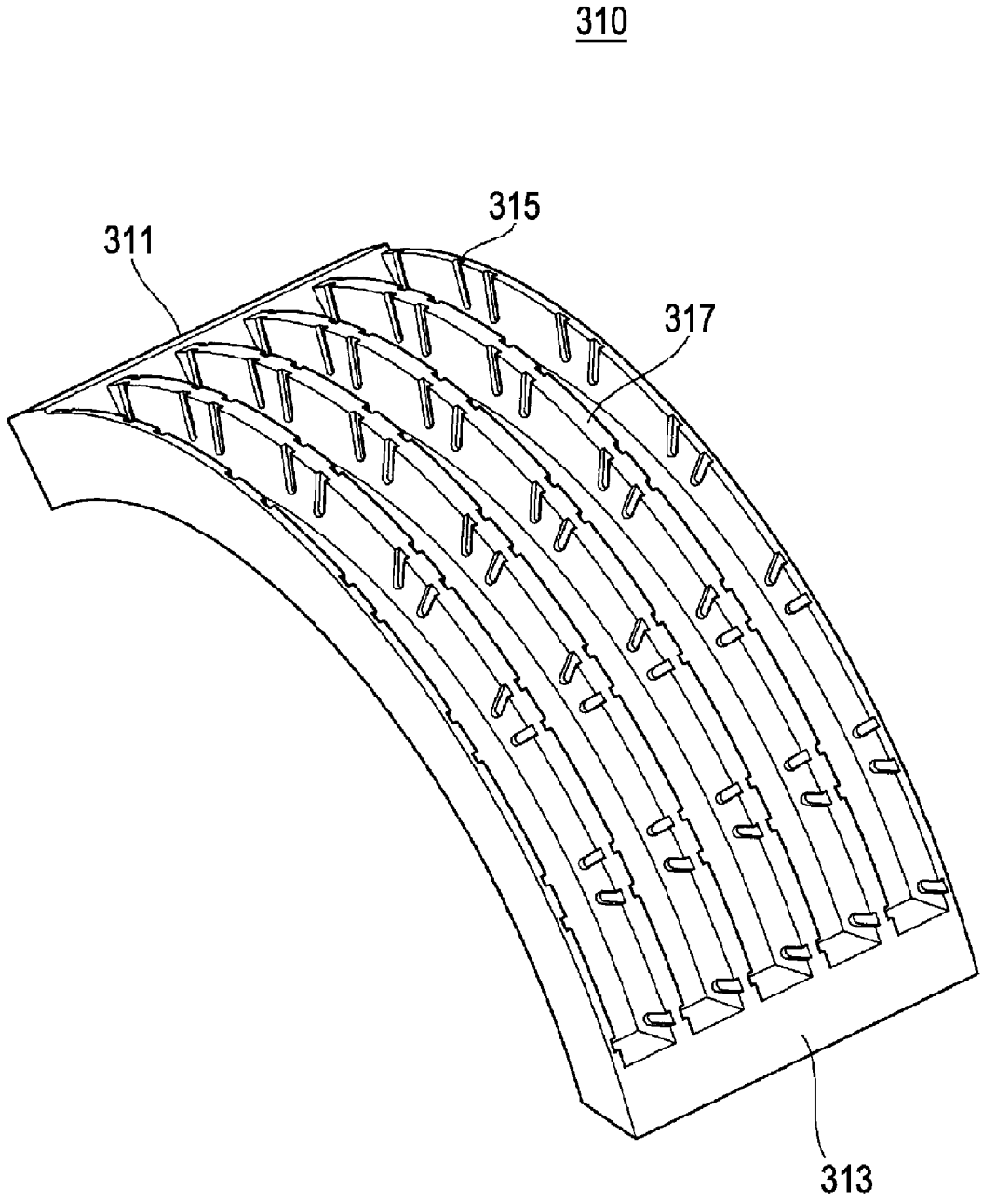
FIG. 11 is a perspective view showing the shape of a support frame.

FIG. 11 is a perspective view independently showing the shape of the support frame 310 of the ultraviolet emission unit 300. As shown in FIG. 11, the support frame 310 is formed by coupling a plurality of support ribs 317 with a pair of coupling ribs 311, 313. Further, each of the support ribs 317 has a positioning groove 315 that fits with a positioning pin 303 described below (see FIGS. 12, 13) for positioning the ultraviolet light emitting element unit 320 and blank unit 300. Note that although omitted in FIG. 11, there is a power source terminal for supplying emission electric power to the ultraviolet light emitting elements 302 of the ultraviolet light emitting element unit 320 inside each of the positioning grooves 315.

Figure 12:
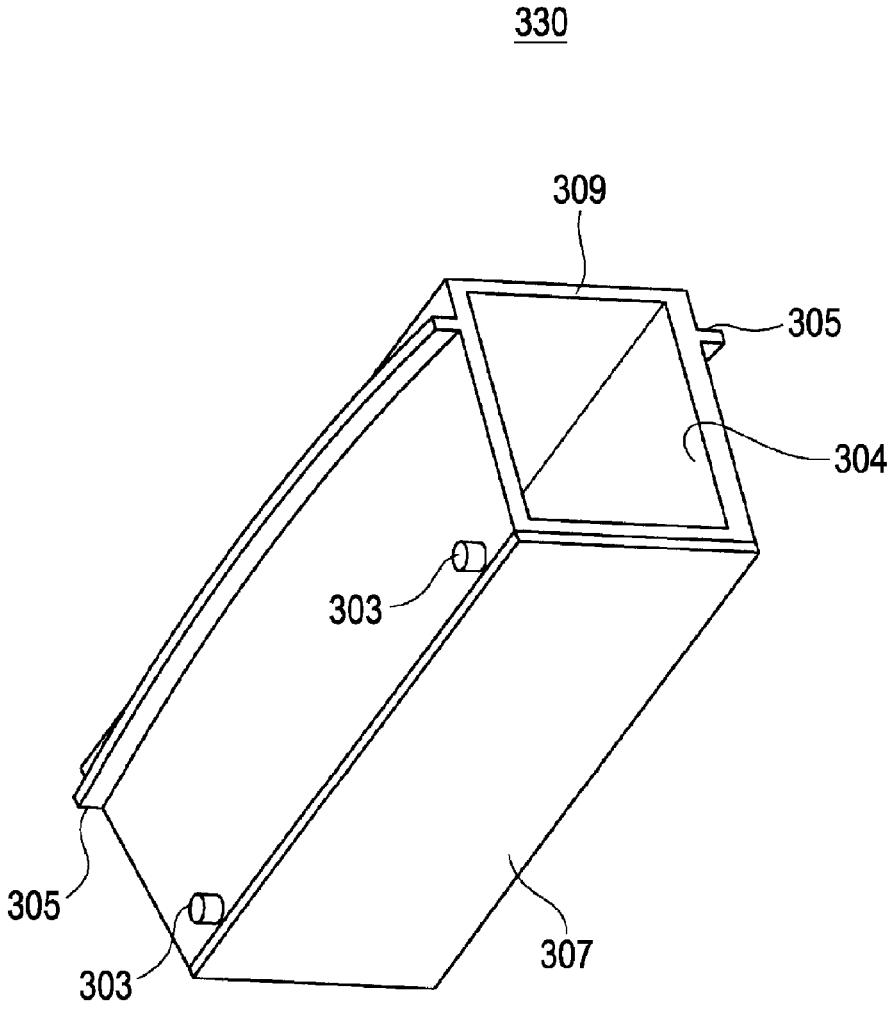
FIG. 12 is a perspective view showing the shape of a blank unit.

FIG. 12 is a perspective view independently showing the bank unit 330. As shown in FIG. 12, the blank unit 330 has a unit block 309 having a hollow rectangular cylinder shape, positioning pins 303 and positioning ribs 305 respectively formed at the side surfaces of the unit block 309. Further a dummy plate 307 is attached to the lower surface of the unit block 309 in stead of the ultraviolet light emitting elements 302.

When the blank unit 330 as described above is attached to the support frame 310 shown in FIG. 11, the positioning pins 303 are slid into the positioning grooves 315. Later, when the positioning ribs 305 are made contact with the upper surfaces of the support ribs 317, the blank unit 330 is positioned at a predetermined height with respect to the support frame 310.

Note that although omitted in FIG. 12, the positioning pin 303 has a relay terminal that makes connect with the power source terminal inside the positioning grove 315 at the distal end thereof. Herewith, when the blank unit 330 is attached to the support frame 310, electrical connection to the adjacent attachment position is formed via the blank unit 330 itself. In other words, electrical connection is cut off unless the ultraviolet light emitting element unit 320 or the blank unit 330 are attached to all of the attachment positions.

Figure 13:
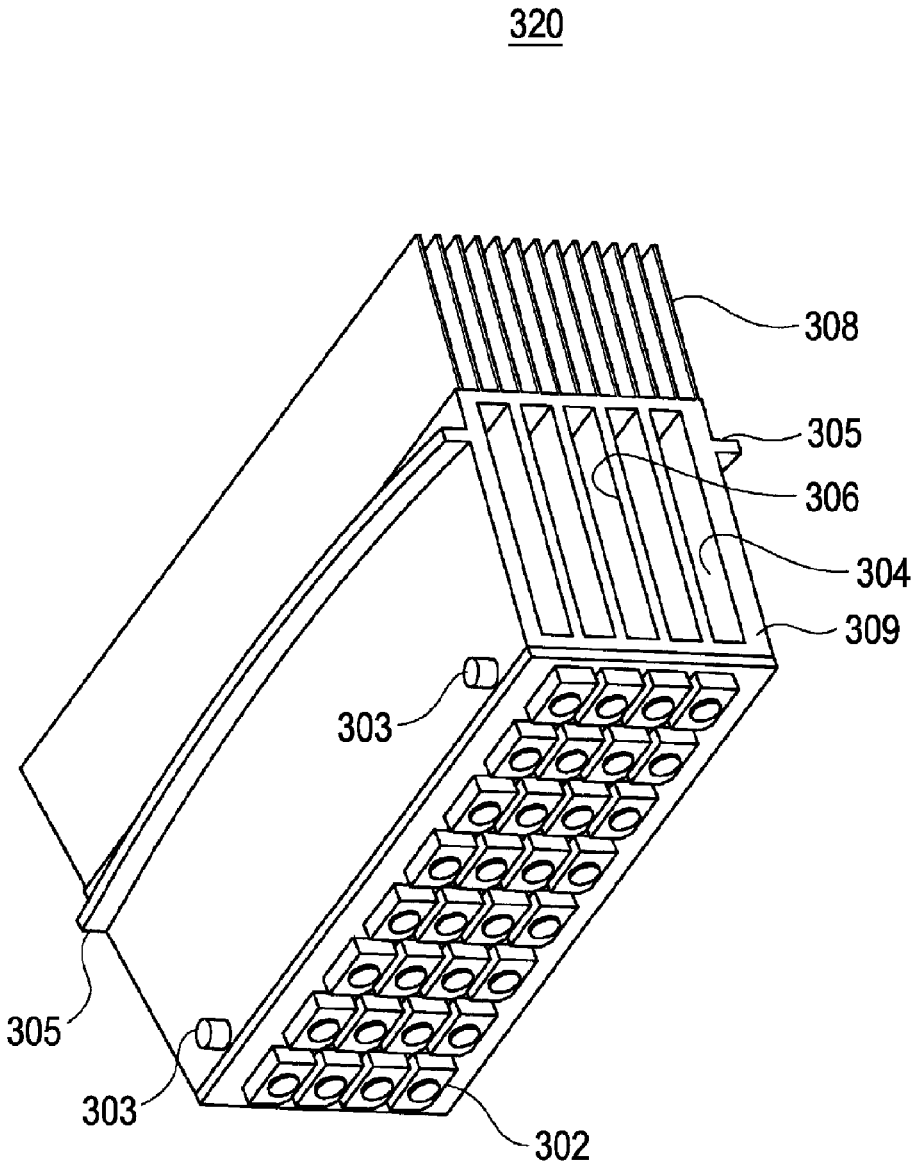
FIG. 13 is a perspective view showing the shape of an ultraviolet light emitting element unit.

FIG. 13 is a perspective view independently showing the ultraviolet light emitting element unit 320. As shown in FIG. 13, the ultraviolet light emitting element unit 320 also has a unit block 309 having a hollow rectangular cylinder shape, positioning pins 303 and positioning ribs 305 formed on the side surfaces of the unit block 309. A number of ultraviolet light emitting elements 302 are attached on the lower surface of the unit block 309. Further, a radiation fin 308 is formed on the upper surface of the unit block 309.

Further, in the ultraviolet light emitting element unit 320, the upper surface and the lower surface of the unit block 309 are coupled with coupling ribs 306 and flow holes 304 that communicates the both ends of the unit block 309 are formed between the gaps of the coupling ribs 306 inside the unit block 309. With the structure, the heat generated by the ultraviolet light emitting elements 302 is efficiently transmitted to the radiation fin 308.

Further, also in the ultraviolet light emitting element unit 320, the positioning pin 303 has a connection terminal that makes connect with the power source terminal inside the positioning grove 315 at the distal end thereof. Herewith, when the ultraviolet light emitting element unit 320 is attached to the support frame 310, emission power force for the ultraviolet emission elements 302 is supplied via the support frame 310, the other ultraviolet light emitting element units 320, and the bank units 330.

In the ultraviolet emission unit 300 having the structure described above, the timing of starting of emission of ultraviolet, the ultraviolet emission amount, and the emission time are set by attaching the ultraviolet light emitting element unit 320 to any position of the support frame 310. Further, the ultraviolet emission unit 300 is mounted on the emission unit carriage 160 of the ink jet type recording apparatus 100 in the state where any one of the ultraviolet light emitting element unit 320 and the blank unit 330 is attached to the all of the attachment positions of the support frame 310.

Accordingly, in the area in which the ultraviolet light emitting element unit 320 is attached to the support frame 310, ultraviolet is emitted to the recording paper 150 supported by the support drum 140. Further, the surface of the ultraviolet light emission unit 300 opposing the support drum 140 is smoothly continued by the each of the ultraviolet light emitting elements 302 of the ultraviolet light emitting element units 320 and the dummy plates of the blank units 330, so that layer flow generated near the support surface 144 is not distorted when the support drum 140 is rotated.

Figure 14:
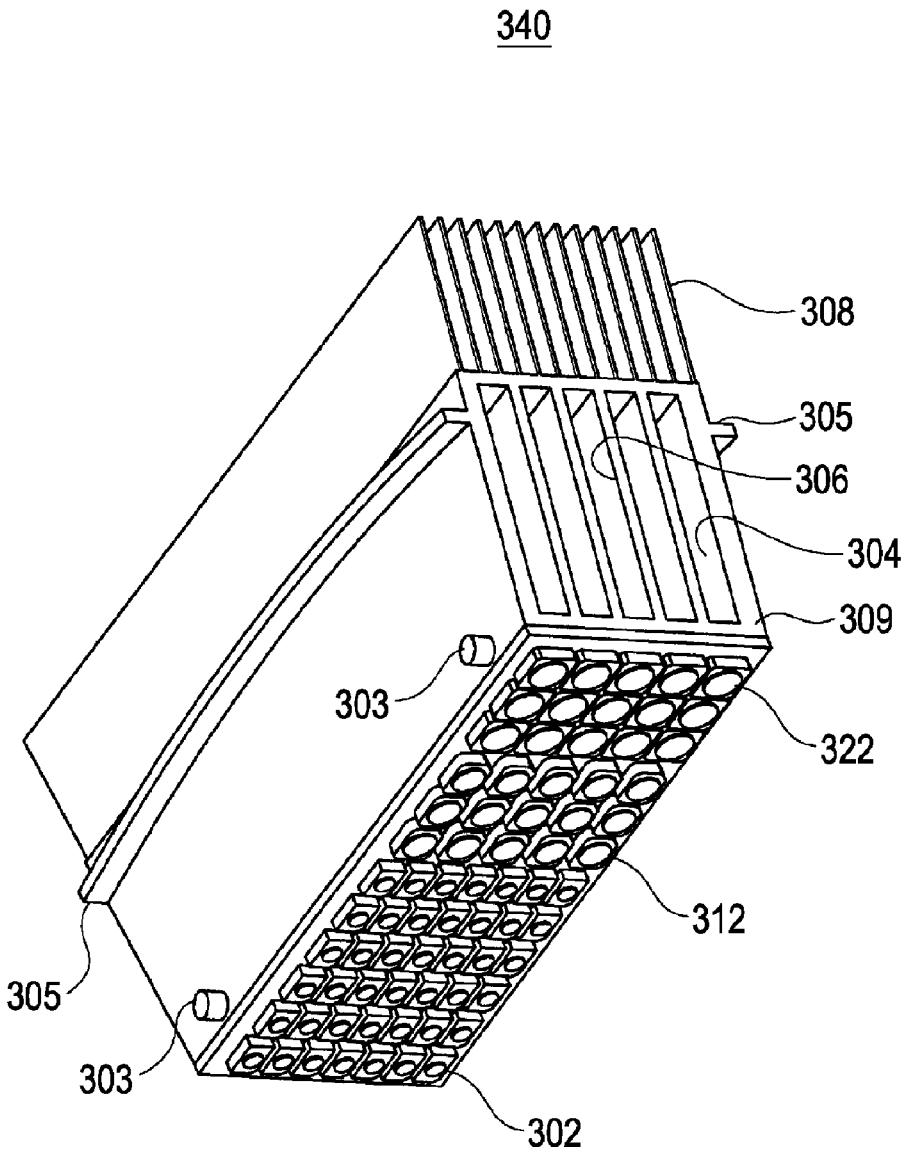
FIG. 14 is a perspective view showing an ultraviolet light emitting element unit having another structure.

FIG. 14 is a perspective view showing the structure of another ultraviolet light emitting element unit 340 of the ultraviolet emission unit 300 as described above which can be attached to the support frame 310. As shown in FIG. 14, the unit block 309 having a radiation fin 308, positioning ribs 305, the positioning pins 303, and the coupling ribs 306 has the same shape as the ultraviolet light emitting element unit 320 shown in FIG. 12.

The unique characteristic of the ultraviolet light emitting element unit 340 is to have three types of ultraviolet light emitting elements 302, 312, 322 on the lower surface of the unit block 309. With the structure, an ultraviolet light source having a wide light emission band can be easily formed. Herewith, by attaching the ultraviolet light emitting element unit 340 to the support frame 310 instead of the ultraviolet light emitting element unit 320, the selection range of emission condition of ultraviolet can be further increased.

Figure 15:
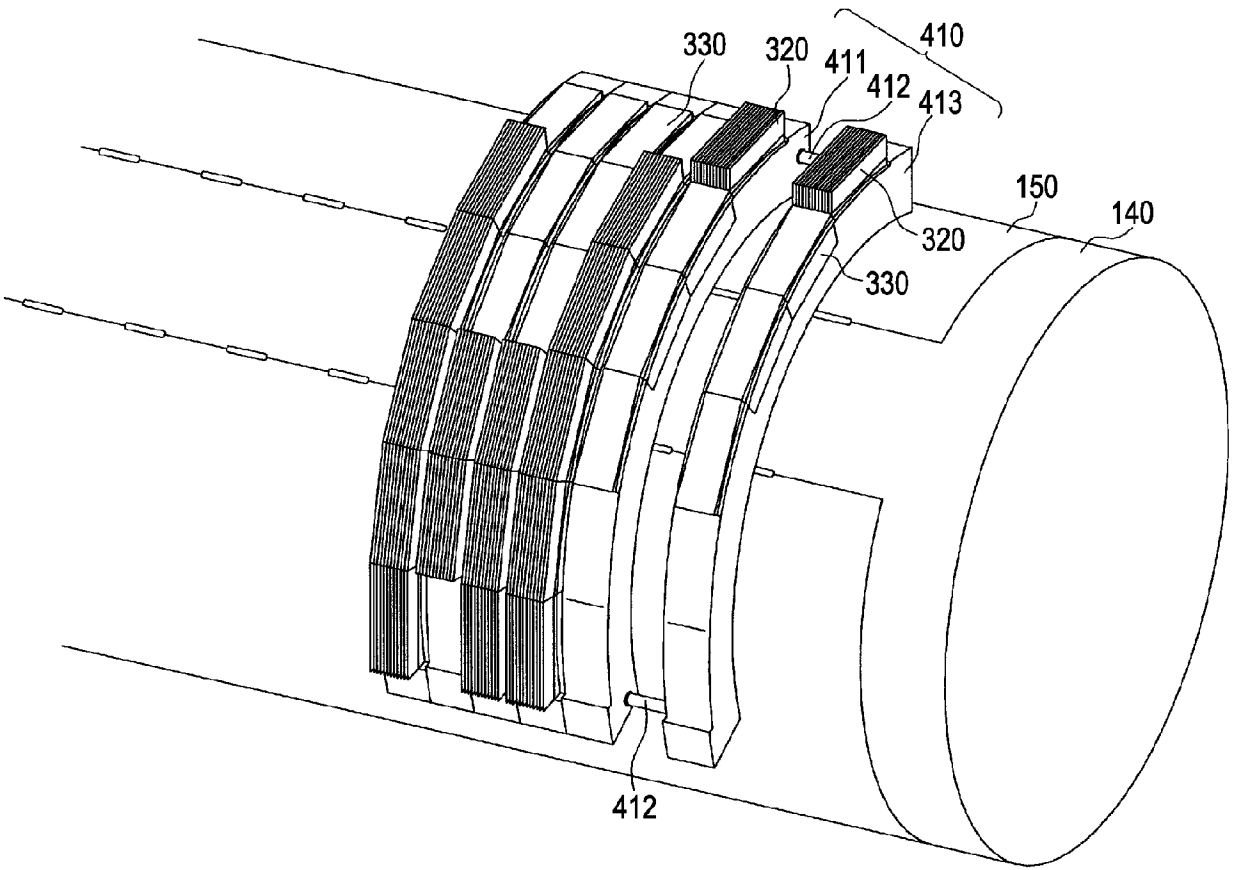
FIG. 15 is a perspective view showing a recording unit according to another embodiment.

FIG. 15 is a perspective view showing the structure of an ultraviolet emission unit 400 according to another embodiment. The ultraviolet emission unit 400 has a support frame 410, the ultraviolet light emitting element units 320, and the blank units 330. Note that the element except the element described below has the same structure and function as that in the other embodiment. Further, the same reference numeral is used to denote the same element as that in the other embodiment, and duplicate explanation is avoided.

The support frame 410 includes a fixed support frame 411, slide axes 412, and a movable support frame 413. The fixed support frame 411 is supported from the emission unit carriage 160 omitted in FIG. 15 and moves along the circumferential surface of the support drum 140.

One end of each of the slide axes 412 is supported by the fixed support frame 411 in a slidable manner. The slide axes 412 are lengthened and shortened with respect to the fixed support frame 411 in parallel with the moving direction of the emission unit carriage 160. The movable support frame 413 is jointed to the other ends of the slide axes 412 and comes close to or apart from the fixed support frame 411 depending on the lengthening and shortening of the slide axes 412.

Further, the fixed support frame 411 mounts plurality lines of ultraviolet light emitting element unit 320 and blank unit 330 disposed along the circumferential direction of the support drum 140. On the other hand, the movable support frame 413 mounts one line of ultraviolet light emitting element unit 320 and blank unit 330. Note that the combination and the mounted number of the ultraviolet light emitting element unit 320 and blank unit 330 are only an example. The distribution of the ultraviolet light emitting element unit 320 and the blank unit 330 is not limited to such an example.

Figure 16:
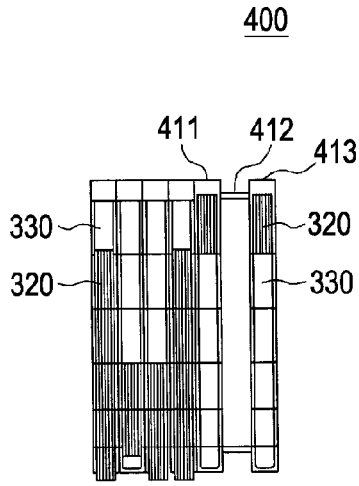
FIG. 16 is a front view showing the layout of an ultraviolet emission unit.

FIG. 16 is a front view showing the layout of the ultraviolet emission unit 400 at a certain point. In this case, the slide axes 412 are let out from the fixed support frame 411 by the length approximately equal to the width of the movable support frame 413. Herewith, the movable support frame 413 is apart from the fixed support frame 411 by the gap corresponding to one line of the ultraviolet light emitting element unit 320.

Figure 17:
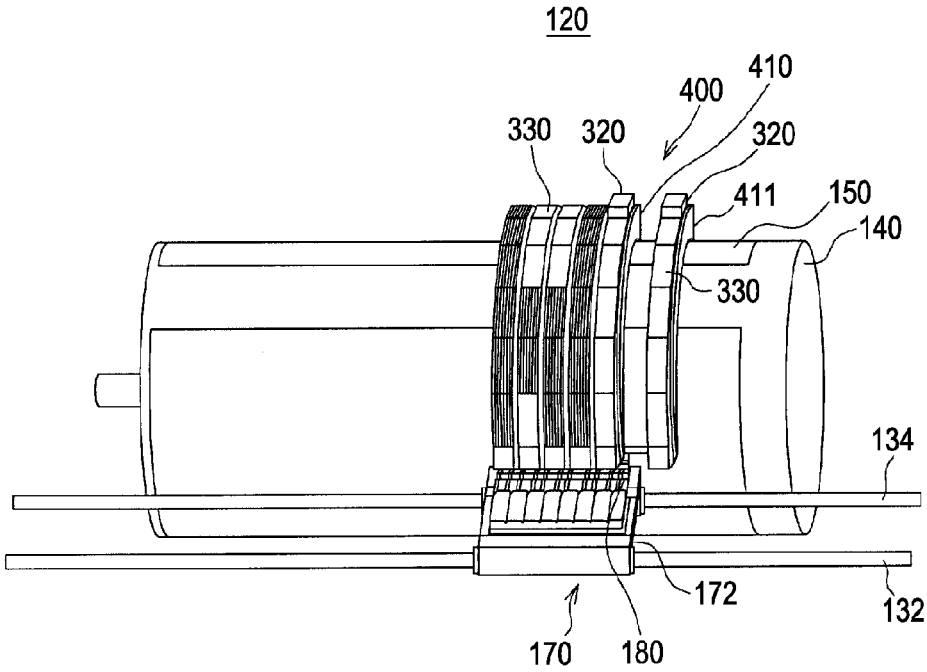
FIG. 17 is a perspective view showing the structure of the ultraviolet emission unit.

FIG. 17 is a diagram showing the state where the ultraviolet emission unit 400 described above is attached to the ink jet type recording apparatus 100. In FIG. 17, the same reference numeral is also used to denote the same element as that in the other embodiment, and duplicate explanation is avoided.

When an image is recorded on the recording paper 150 supported by the support drum 140 by the ink jet type recording apparatus 100, the ultraviolet emission unit 400 moves along the circumferential surface of the support drum 140 in the longitudinal direction thereof in synchronization with recording unit carriage 170. On the other hand, the support drum 140 rotates in the direction shown by the arrow R in FIG. 17 while supporting the recording paper 150.

The ultraviolet curing type ink ejected toward the recording paper 150 from the recording head 180 passes through the lower side of the ultraviolet mission unit 400 right after adhered on the recording paper 150. Herewith, the ultraviolet curing type ink immediately begins to start curing.

However, as described above, the movable support frame 413 is apart from the fixed support frame 411 by not less then one line of the ultraviolet light emitting element unit 320. Accordingly, the ultraviolet curing type ink is emitted by the ultraviolet emitted from the ultraviolet light emitting element unit 320 mounted on the movable support frame 413 after the support drum 140 is rotated not less than one revolution after emission to ultraviolet curing type ink is started.

By the structure, the slide axes 412 can be lengthened and shortened with respect to the fixed support frame 411, so that the timing of emission can be changed to any timing in accordance with a requested print condition by the ultraviolet light emitting element unit 320 mounted on the movable support frame 411. Further, the ultraviolet light emitting element unit 320 mounted on the movable support frame 413 can considerably change the timing at which ultraviolet is emitted to the ultraviolet curing type ink on the recording paper 150.

Note that in the example shown in FIG. 17, the movable support frame 413 is disposed at the moving direction side end of the ultraviolet emission unit 400 which is often used for formation of, for example, an overcoat layer. However, the arrangement of the movable support frame 413 is not limited to the side end. Further, the movable support frame 413 may have the shape by which plurality lines of ultraviolet light emitting element unit 320 can be attached. Further, plurality of movable support frames 413 which are independently moved may be provided.

The invention is described by exemplifying the ink jet type recording apparatus 100. However the structure of the recording apparatus described above or a liquid ejecting apparatus may also be applied to a color material ejecting apparatus used for manufacture of a color filter for a liquid crystal display, an electrode forming apparatus used for manufacture of an organic EL display, an FED (field emission display), or the like, a sample ejecting head used for manufacture of a bio chip, and the like.

The invention is described above by using the embodiments. However the technical scope of the invention is not limited to the scope of the above described embodiments. It is apparent for a person skilled in the art that various changes and modifications can be made to the above embodiments. It is apparent from the description of the claims that such changed and modified embodiments can be also included in the technical scope of the invention.

What is claimed is:

1. A recording apparatus comprising:

a support drum that rotates while supporting a recording medium on a support surface of the support drum;

a first guide axis extending in parallel with a rotation axis of the support drum along the support surface;

a second guide axis extending in parallel with the rotation axis of the support drum along the support surface;

a recording unit carriage that is guided by the first guide axis and moves back and forth along the support surface;

an emission unit carriage that is guided by the second guide axis and moves back and forth along the support surface;

a recording head for ejecting ultraviolet curing type ink toward a recording medium supported on the support surface, the recording head being mounted on the recording unit carriage and the recording head having a first head unit and a second head unit each of which ejects a different type of ultraviolet curing type ink to each other to a different position to each other along an extending direction of the first guide axis; and an ultraviolet emission unit being mounted on the emission unit carriage and disposed at a down stream side of the recording unit carriage in a rotation direction of the support drum, the ultraviolet emission unit emitting ultraviolet to the ultraviolet curing type ink ejected from the recording head and adhered on the recording medium, the recording apparatus forming an image by ejecting ultraviolet curing type ink on an entire surface of the recording medium supported by the support drum by moving the recording unit carriage along the first guide axis for each time the support drum rotates at least one revolution, the emission unit carriage moves approximately in synchronization with the movement of the recording unit carriage, wherein the ultraviolet emission unit has a first ultraviolet light source and a second ultraviolet light source disposed in the extending direction of the second guide axis and the first ultraviolet light source and the second ultraviolet light source independently generate ultraviolet, and the first ultraviolet light source being disposed to correspond to the first head unit, the second ultraviolet light source being disposed to correspond to the second head unit, the first ultraviolet light source and the second ultraviolet light source generate ultraviolet by an emission condition in which at least one of intensity, wavelength, and emission time of ultraviolet is different to each other.

2. The recording apparatus according to claim 1, each of the first ultraviolet light source and the second ultraviolet light source having a plurality of ultraviolet light emitting elements.

3. The recording apparatus according to claim 1, wherein the second ultraviolet light source emits ultraviolet with respect to ultraviolet curing type ink adhered on the topmost layer of the recording medium after the support drum is rotated not less than one revolution after the ultraviolet curing type ink is adhered on the recording medium.

4. The recording apparatus according to claim 3, wherein the second ultraviolet light source moves along the extending direction of the second guide axis with respect the first ultraviolet light source.

5. The recording apparatus according to claim 1, wherein each of the first ultraviolet light sources and the second ultraviolet light source includes a plurality of ultraviolet light emitting elements arranged in the rotation direction of the support drum and at least a part of the plurality of ultraviolet light emitting elements is independently turned on or turned off.

6. The recording apparatus according to claim 1, wherein each of the first ultraviolet light sources and the second ultraviolet light source includes a plurality of ultraviolet light emitting elements arranged in the direction parallel to the extending direction of the guide axis and at least a part of the plurality of ultraviolet light emitting element is independently turned on or turned off.

7. The recording apparatus according to claim 1, wherein the first ultraviolet light source and the second ultraviolet light source includes a plurality of ultraviolet light emitting elements having a different emission wavelength to each other.

8. The recording apparatus according to claim 1, wherein each of the first ultraviolet light sources and the second ultraviolet light source has a support frame and a plurality of ultraviolet light emitting element units that independently generates ultraviolet when attached to the support frame, the ultraviolet light emitting element units being capable of independently attaching to and detaching from the support frame, and emission condition including at least one of the intensity, wavelength, and emission time of ultraviolet emitted to the ink adhered on the recording medium is changed by appropriately attaching or detaching the ultraviolet light emitting element units.

9. The recording apparatus according to claim 8, wherein at least one of emission intensity and emission wavelength of a part of the plurality of ultraviolet light emitting element units is different from that of the other ultraviolet light emitting element unit.

10. The recording apparatus according to claim 1, wherein each of the first ultraviolet light sources and the second ultraviolet light source has a support frame and a plurality of ultraviolet light emitting element units that independently generates ultraviolet when attached to the support frame, the ultraviolet light emitting element units being capable of independently attaching to and detaching from the support frame, and the plurality of ultraviolet light emitting element units have the same shape and same size to each other and attachment positions of the plurality of ultraviolet light emitting element units are changed.

11. The recording apparatus according to claim 1, wherein each of the first ultraviolet light sources and the second ultraviolet light source includes a support frame, a plurality of ultraviolet light emitting element units that independently generates ultraviolet when attached to the support frame, the ultraviolet light emitting element units being capable of independently attaching to and detaching from the support frame, and a blank unit that does not generate ultraviolet, the blank unit being capable of independently attaching to and detaching from the support frame, and the plurality of ultraviolet light emitting element units and the blank unit have the same shape and same size to each other and attachment positions of the plurality of ultraviolet light emitting element units and the blank unit to the support frame are changed.

12. A liquid ejecting apparatus comprising:

a support drum that rotates while supporting a recording medium on a support surface of the support drum;

a first guide axis extending in parallel with a rotation axis of the support drum along the support surface;

a second guide axis extending in parallel with the rotation axis of the support drum along the support surface;

a recording unit carriage that is guided by the first guide axis and moves back and forth along the support surface;

an emission unit carriage that is guided by the second guide axis and moves back and forth along the support surface;

a liquid ejecting head for ejecting ultraviolet curing type liquid toward a recording medium supported on the support surface, the liquid ejecting head being mounted on the recording unit carriage and the liquid ejecting head having a first head unit and a second head unit each of which ejects a liquid containing a different type of ultraviolet curing component to each other to a different position to each other along an extending direction of the first guide axis; and an ultraviolet emission unit being mounted on the emission unit carriage and disposed at a down stream side of the recording unit carriage in a rotation direction of the support drum, the ultraviolet emission unit emitting ultraviolet to the ultraviolet curing type liquid ejected from the liquid ejecting head and adhered on the recording medium, the liquid ejecting apparatus forming an image by ejecting ultraviolet curing type liquid on an entire surface of the recording medium supported by the support drum by moving the recording unit carriage along the first guide axis for each time the support drum rotates at least one revolution, the emission unit carriage moves approximately in synchronization with the movement of the recording unit carriage, wherein the ultraviolet emission unit has a first ultraviolet light source and a second ultraviolet light source disposed in the extending direction of the second guide axis and the first ultraviolet light source and the second ultraviolet light source independently generates ultraviolet, and the first ultraviolet light source being disposed to correspond to the first head unit, the second ultraviolet light source being disposed to correspond to the second head unit, the first ultraviolet light source and the second ultraviolet light source generate ultraviolet by an emission condition in which at least one of intensity, wavelength, and emission time of ultraviolet is different to each other.

* * * * *